United States Patent [19]

Jaffe et al.

[11] Patent Number: 4,585,519

[45] Date of Patent: Apr. 29, 1986

[54] AUTOMATED CHEMICAL MILLING PROCESS

[75] Inventors: Herbert R. Jaffe, Plainview; Irwin Mitzelman, Wantagh, both of N.Y.

[73] Assignee: Grumman Aerospace Corporation, New York, N.Y.

[21] Appl. No.: 465,518

[22] Filed: Feb. 10, 1983

[51] Int. Cl.[4] ..... C23F 1/02; B44C 1/22; C03C 15/00; C03C 25/06

[52] U.S. Cl. ..... 156/645; 156/651; 156/656; 156/659.1; 156/664; 156/658; 156/661.1; 156/665

[58] Field of Search ..... 156/345, 645, 651, 656, 156/659.1, 661.1, 664, 665, 658, 905; 252/79.2, 79.3, 79.5

[56] References Cited

U.S. PATENT DOCUMENTS

| | | | |
|---|---|---|---|
| 2,888,335 | 5/1959 | Atkins et al. | 41/43 |
| 3,227,589 | 1/1966 | Deutsch | 156/13 |
| 3,380,863 | 4/1968 | Silberberg | 156/12 |
| 3,555,950 | 1/1971 | Gijsbers et al. | 83/171 |
| 3,745,079 | 7/1973 | Cowles et al. | 156/18 |
| 3,803,960 | 4/1974 | Pearl et al. | 83/56 |
| 3,805,650 | 4/1974 | Pearl | 83/56 |
| 3,895,358 | 7/1975 | Pearl | 340/172.5 |
| 3,988,254 | 10/1976 | Mori | 252/99 |
| 3,991,636 | 11/1976 | Devillers | 83/12 |
| 4,137,118 | 1/1979 | Brimm | 156/345 |
| 4,145,723 | 3/1979 | Mucha et al. | 360/79 |
| 4,171,657 | 10/1979 | Halberschmidt et al. | 83/886 |
| 4,294,649 | 10/1981 | Sarka | 156/664 X |
| 4,325,779 | 4/1982 | Rossetti | 156/651 |

OTHER PUBLICATIONS

Kongsberg 1800 S Series Flat-Bed Drafting Tables, Kongsberg Data Systems.

Kongsberg Drafting Tools, Kongsberg Systems Inc.

Pressurised Ink System—Noritron, Kongsberg Data Systems.

2.6 Tangentially Controlled Scribing Tool, Oct. 80, p. 9, Description and Tool Fitting.

ASEA Pamphlet, Industrial Robot System, pp. 1-12, Edition 3, YB 11-101 E, ASEA Inc.

ASEA Operation Manual, Industrial Robot System, pp. 1-72, Edition 2, YB 110-301 E, YFB Jun. 1977, ASEA Inc.—Electronics Division.

*Primary Examiner*—William A. Powell

*Attorney, Agent, or Firm*—Scully, Scott, Murphy & Presser

[57] ABSTRACT

The specification discloses an automated chemical milling process for metal articles. The metal article is first coated with an etchant resist coating. In one embodiment the area to be etched is digitized to define the x,y coordinate values for the perimeter line around the area. A CPU is used to control a flat bed drafting table with a tangially controlled scribing tool to cut through the resist coating along the perimeter line. If plural etching steps are used, each perimeter line is digitized and scribed or cut in a similar manner. All but one of the perimeter lines are recoated and marked and the resist coating within the remaining perimeter line is removed. The metal part is then etched as desired. If plural etching steps are used the resist coating for each separate area is removed between sequential etching baths. In a second embodiment, the x,y,z point coordinate values for a perimeter line on a three dimensional work piece are defined, and the scribing operation is done by a robotic device controlled by a CPU. In a third embodiment, new template or mask geometry is created on a CRT and digitized for subsequent control of the plotting table or other robotic device. Digital signals are used to define the x,y or x,y,z point coordinates values while analogue signals are used to control the scribing tool.

25 Claims, 11 Drawing Figures

AUTOMATED CHEMICAL MILLING PROCESS

BACKGROUND OF THE INVENTION

1. Field of the Invention

The field of the present invention relates to an improved automated method for chemically milling metal and metallic structures. Chemical milling is widely employed in the aircraft and aerospace industries to remove excess metal from metal parts wherein the removed metal is not essential to the strength of the component part. The chemical milling process normally employs a series of masking and metal removal steps. The metal is removed by an etching bath which may be either caustic or acid depending upon the metal or alloy being etched. Chemical milling may be used to produce one piece structures having a skin and load bearing ribs or stiffeners that provide lightweight alternatives for traditional aircraft skin and stringer constructions.

2. Discussion of the Prior Art

The prior art has used chemical milling to reduce the weight of metal parts intended for use in aircraft or aeronautic applications for over twenty years. Chemical milling is widely used to increase the strength to weight ratio of component parts in the aircraft airframe. Chemical milling traditionally involves the steps of masking and chemically milling a metallic work piece and may repeat the sequence several times to further alter the work piece configuration.

U.S. Pat. No. 4,137,118 discloses a method of chemically etching an efficient light weight structure by removing excess metal to form the ribs and skin of an aircraft structure. The etching step is repeated to sequentially undercut and impart an "I" or "T" section to the ribs and to reduce the thickness of the skin.

U.S. Pat. No. 3,745,079 discloses a method of chemically etching a titanium alloy stock for use as a structural member in an aircraft.

U.S. Pat. No. 2,888,335 discloses a process of chemically etching a work piece that sets forth a method of sequentially etching the work piece with multiple cuts in the mask material to produce a plurality of etched levels in the work piece. In between each etching bath, a portion of the mask is removed so that the final configuration has an etch pattern of varying depths throughout the work piece.

U.S. Pat. No. 3,380,863 discloses masking material for use in chemical etching having a styrene/butadiene block copolymer composition. This material is widely used in chemical milling processes for masking the part to be protected during the etching bath.

At the present time, the prior art methods comprise the steps of marking the aluminum or titanium stock with a reference mark or tooling hole for conveying the stock through the etching solution. The metal part is then covered or coated with the butadiene/styrene copolymer masking material. A template is laid over the masking material and the masked material is hand-cut along the template line. The masking material is then marked with a marking pen along the cut or scribe line. These steps are repeated with separate masks when separate etching or milling levels are contemplated. In the event multiple etching baths are desired, the cut mask line is recovered with a sealant material. After all of the stencil marks have been cut, and the secondary cuts have been coated, one portion of the mask material is removed. The metal plate is then etched and rinsed in a counterflow rinse water. The second mask area is removed, and the work piece is reimersed in the etching bath. The work piece is rinsed again and the process is repeated for the desired number of etching steps. At the conclusion of the etching step, the work piece is "desmutting". A typical "desmutting" agent is disclosed in U.S. Pat. No. 3,988,254.

There are two problems in the present prior art method of chemical milling that are solved by the present invention.

(a) controlling the depth of the cut through the masking material. At present, the mask is handscribed by skilled workmen. If the cut is too deep, the cut allows the etching bath to etch into the metal and undercut the mask. If the cut is too shallow, and the mask material is not completely severed, it will "blowout", blister, or tear when that portion of the mask is removed. This necessitates a time-consuming repair step for the stencil mask. In addition, if the "blowout" is not detected, the work piece will be undercut by the etching material.

(b) the time consumed in laying each stencil on the work piece, marking each line to be cut, and cutting each line by hand is substantial. A typical three foot by four foot work piece requires six to eight hours of hand labor to handmark and cut each of the areas to be etched. The automated process of the present invention can do the same larking and cutting in 11 minutes. In addition, it can perform cuts that cannot be done by hand.

If the chemical milling is done on a three dimensional work piece, all of the foregoing problems are accentuated. In addition, it is necessary to preform the metal part around a master mold in a molding or die-stamping step to provide the desired three dimensional configuration. Each of the stencils must be provided with the appropriate compensation for three dimensional positioning. In the present prior art practice, after the metal plates have been preformed to an approximate three dimensional configuration, they are pinned to a master mold, and the individual stencils are also pinned to provide intimate contact between the stencil and the work piece. Further, the three dimensional nature of the work piece makes it even more difficult to accurately hand-cut the stencil to the desired depth.

The present invention involves the new use of two existing devices which have heretofore been used for other tasks.

In the drafting and cartography fields, large computer operated drafting machines have been used to mark blueprints and scribe plastic stencils that are intended for use in photoreproduction processes. These machines are quite large, having a drafting area that may be 8 feet wide 34 feet long. A motorized carriage traverses the drafting bed in both the x and y dimensions and carries on its carriage a plurality of marking pens. One such device is the Kongsberg 1800S Series Flatbed Drafting Table. This drafting table may be fitted with a variety of drafting tools including a tangentially controlled scribing tool. This tool uses a single knife or chisel and is normally used for cutting and stripping material used in the photoreproduction of integrated circuits. The knives are used to scribe coated films.

U.S. Pat. No. 3,555,950 discloses a device for automatically cutting a photomask for use in producing integrated circuits. In this device, the aluminum foil is cut and the plastic laminent material is retained to define an optically transparent negative for producing an integrated circuit board.

Computer controlled cutting means have been widely used in the garment industry for cutting one or more sheets of fabric to a desired pattern size. These devices also have drive motors for moving a cutting tool in x and y directions. Examples of computer operated cutting devices are disclosed in U.S. Pat. Nos. 3,803,960, 3,805,650, 3,895,358, 3,991,636 and 4,171,657.

While the foregoing devices have been used for computer controlled cutting of cloth and photomasks in the prior art, they have not been used or applied to the chemical milling process. The chemical milling process has remained essentially unchanged for over 20 years. The computer controlled flatbed drafting tables and cutting tables have been in existence for over 10 years. To the best of applicants' knowledge, these devices have not been used in the chemical milling process and their use in this field provides significant advantages in both speed and accuracy.

The foregoing devices, while suitable for application to chemical milling involving flat stock, are not suitable for use in chemical milling processes on three dimensional work pieces. For three dimensional milling, the tangentially controlled scribing tool is mounted on a robotic device that may be computer controlled through the x,y,z dimensions to provide an accurate scribing depth as the robotic device traverses the three dimensional contoured surface. One robotic device that may be modified for use in the chemical milling process is manufactured by ASEA, Inc. and is described in the ASEA pamphlet YB 11-101 E.

Both the ASEA robotic device, and the Kongsberg Drafting Table are capable of traversing an existing template to derive a series of point-by-point measurements along the perimeter defined by the template. These point-by-point measurements may be recorded and stored on magnetic tape. These point-by-point measurements may then be used to scribe the mask covered work piece with the tangentially controlled scribing tool carried by the Kongsberg plotter or the ASEA robot.

An alternate means of generating the instructions for controlling the movements of the robotic device or the flatbed drafting device is to create new template geometry on a CRT via an existing computer program that is currently sold under the "CADAM" tradename. This program will define the x and y coordinate values of the newly created mask before they are digitized and stored on magnetic tape.

SUMMARY OF THE INVENTION

The present invention may be summarized as an automated chemical milling process for metals and metallic articles. It includes digital automation and the application of two separate and existing devices to a field of use in which they have not been previously used. The present invention includes the steps of coating the metal that is to be milled or etched with an etchant resistant mask, such as a styrene copolymer. The perimeter of the area to be etched is then digitized to define a plurality of point definitions along the x,y axis of the flat metal stock, or through a set of x,y,z axes for three dimensional work pieces. If more than one area is to be etched in a sequential etching process, the values of all of the coordinates are defined and stored on a magnetic storage medium such as a magnetic tape, a disc drive, or a bubble memory means.

The process includes the step of automatically scribing the metal and the coating with a scribing tool wherein the scribing tool cuts through the resist coating along the perimeter defined by the x,y coordinate values, or by the x,y,z coordinate values on three dimensional work pieces. After each of the mask areas have been scribed, the cut lines are marked for visibility to assist the operator in removing areas of the resist coating prior to the etching step. If the work piece is to be involved in a sequential etching operation, the sequential cut lines are recoated with a temporary sealant to prevent the entry of the etching bath into the scribe line.

After the resist coating has been removed from the area(s) to be etched, the work piece is immersed into an etching solution for a predetermined period of time to remove a predetermined amount of metal from the uncoated area(s). After the etching step has been completed, the etching bath is neutralized with a counterflow water bath. If sequential etching steps are involved, the second resist coating covering the second area to be etched is removed, and the partially coated metal is then reimmersed in the etching solution for a predetermined period of time. This series of steps is then completed until the work piece has been etched to its final configuration. Following the final etching bath, the work piece is then "de-smutted" to remove the layer of metallic residue left by the etching bath.

The present invention includes the digitizing of existing masks to form x,y coordinate values for each of the perimeter lines defined by an existing mask with respect to either two or three dimensional work pieces. Alternately, new template geometry may be created on a CRT connected to a CPU having the appropriate software. One software program particularly appropriate for the creation of new template geometry is the CADAM software, a commercially available licensed software package.

The present invention uses an electronically controlled scribing tool that exerts a predetermined amount of pressure against a cutting knife which engages the resist coating and the base metal to be etched. The cutting pressure may be very carefully controlled to provide an even and accurate cutting depth through the resist coating and 0.001 inch into the work piece.

The present invention may also be used with "nesting" software to etch a plurality of metal parts from a single large piece of metal stock wherein each of the parts are etched simultaneously by the etching bath. An example of one type of software capable of "nesting" the parts onto a metal plate is the CAMSCO software, a commercially available licensed software package.

It is therefore an object of the present invention to provide an automated chemical milling process for chemically etching metal or metallic parts.

It is another object of the present invention to provide a new use for known and existing devices by automating these devices and applying them to the chemical milling or etching process.

It is another object of the present invention to provide a vastly superior product by accurately controlling the depth of cut made by the cutting knife as it cuts through the resist coating to define the areas to be etched.

It is another object of the present invention to vastly reduce the amount of manpower needed to chemically mill and lighten metal parts intended for use in the aircraft and aerospace industry.

It is also an object of the present invention to eliminate an initial step of marking the registration or tooling holes in the work piece prior to the beginning of the work piece cycle.

BRIEF DESCRIPTION OF THE DRAWINGS

The foregoing objects and advantages of the present invention may be more readily understood by one skilled in the art with reference being had to the following detailed description of the several preferred embodiments thereof, taken in conjunction with the accompanying drawings wherein like elements are designated by identical reference numerals throughout the several views, and in which.

DETAILED DESCRIPTION OF THE PREFERRED EMBODIMENTS

Figure 1:
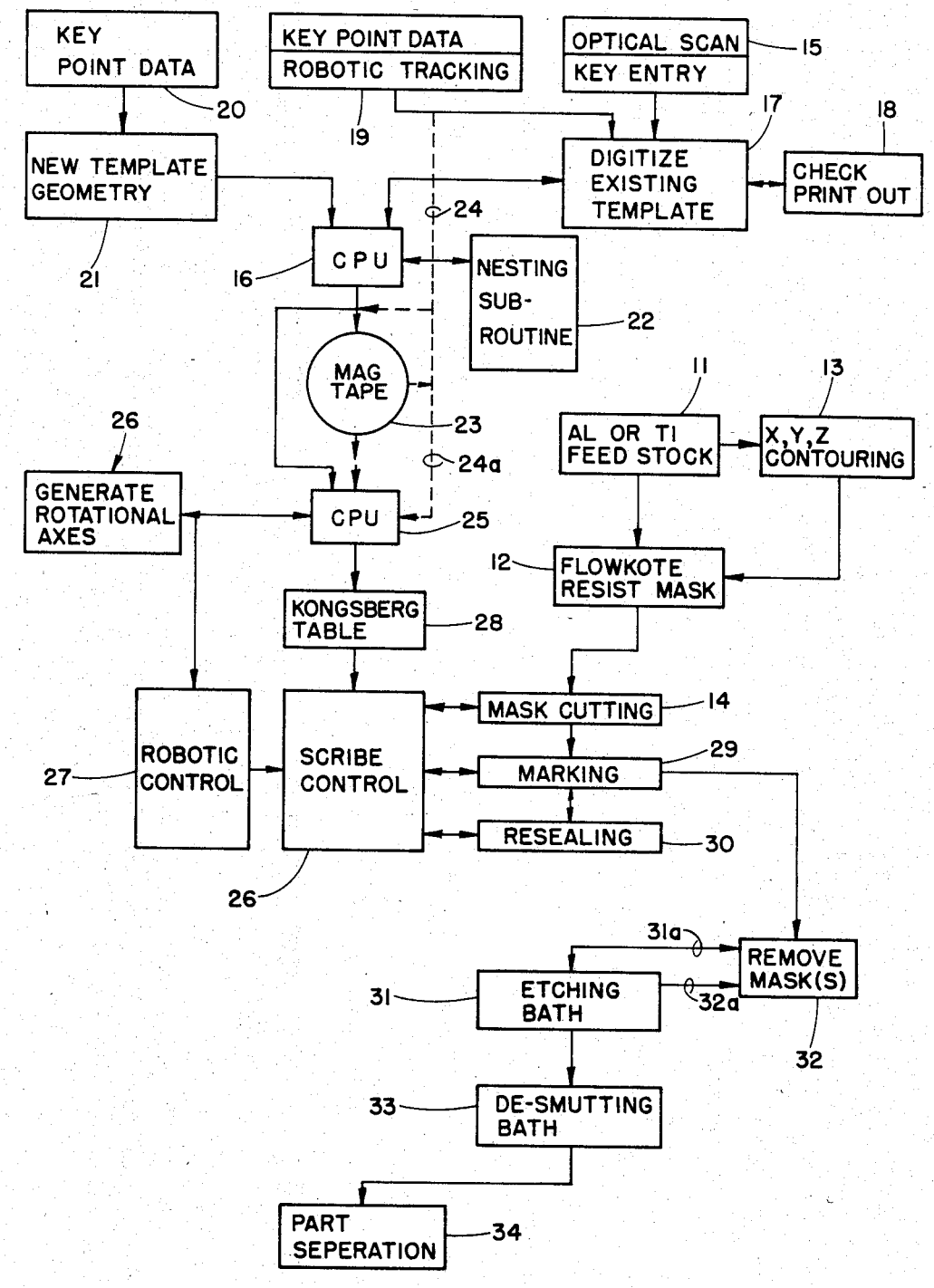
FIG. 1 is a schematic flow chart of the method or process of the present invention.

Referring to FIG. 1, the automated chemical milling process of the present invention is set forth in a diagramatic flow chart. The aluminum alloy or titanium alloy feed stock 11 is first cut to size for the part to be produced, or a series of parts when a plurality of parts are intended to be produced from a single piece of feedstock. If the feed stock is a flat stock, it then proceeds to the flow coating process 12 wherein it is flow coated with the styrene/butadiene copolymer resist mask sold under the tradename of "Turco Mask 522". "Turco" is currently available from Turco Products, Inc., Wilmington, Calif. If the feed stock is intended for use as a three dimensional work piece, and is not provided as a three dimensional feed stock, it then proceeds to a contouring or stamping step 13 wherein the flat feed stock is contoured to the desired three dimensional configuration.

After the feed stock has been coated with the styrene/butadiene copolymer, it then proceeds to the mask cutting step 14. As was indicated previously, in the prior art the mask cutting was accomplished by laying a template over the feed stock and marking the outline of the template on the feed stock. The marked outline is then hand cut so as to cut through the resist coating and lightly score the surface of the metal work piece. The desired depth of cut into the metal work piece is 0.001 inches. Current military specifications for use in aircraft intended for purchase by the U.S. Government proscribe a maximum cut into the work piece of 0.004 inches. If the cut is too deep, the subsequent etching step will undercut the resist coating and if the cut is not deep enough, it will cause a "blow-out" when the center portion of the template is removed for etching. The "blow-out" must then be retouched by hand, which is a time consuming, labor intensive operation.

The present invention automates the chemical milling process by one of three separate beginning steps. As indicated at 15, an existing template may be placed on top of the work piece, and an optical scan made of the template. All of the initial starting marks, the work piece size, the template number and other desired information is keyed into memory along with the optical scan to provide the data necessary to align the cutting device at the appropriate point on the work piece when the mask cutting operation 14 begins. In lieu of using an optical scanning device, a stylus may be used to trace the outline of the template while each of the reference points along the template are keyed into memory via the CRT. For a simple, flat two dimensional work piece, each of the the straight lines could be keyed by placing the stencil at the corner, and keying in the positional data and cut orientation. The stencil would then be moved to the end of that particular straight line and the second key point set of data would be entered. These steps would be repeated around the entire perimeter of the template until the desired area to be etched had been completely defined by the reference point data.

In the event the work piece was intended in a sequential or multiple etching process, the next template describing the second area to be etched would then be overlaid with respect to the initial reference marks and it would be optically scanned, or traced with a stylus pencil to derive the key point data for the existing template.

Simultaneously with the optical scan and the initial key data steps, the CPU 16 would be digitizing the x,y coordinate values of each of the key points entered at 15. The digitizing step is indicated as a separate step 17 in FIG. 1 inasmuch as a variety of methods for digitizing an existing template exist. Two methods for digitizing an existing template were set forth above, but is apparent to one skilled in the data processing art that a variety of methods could be used to define the x,y coordinate values and convert them to digital form for use in a conventional CPU 16.

After the template has been converted to digital form, a printout is produced as indicated at 18. This printout may be done with a Kongsberg flatbed drafting table similar to the one that will be used with respect to the mask cutting operation 14 later on in the process. The Kongsberg flatbed drafting table currently available from "Kongsberg North America, Inc.," 135 Fort Lee Rd., Leonia, N.J. 07605. Any printout device will work providing it is capable of generating a full size template that may be physically checked against the template that was entered via the optical scan or key data entry indicated at 15.

The entry of the x,y,z coordinate values for the robotic device is similar to that used for the digitizing of existing templates for flat feed stock.

As was indicated previously, it is customary to initially preform flat feed stock into its desired three dimensional configuration as indicated at 13. The preformed flat stock is then placed onto a master mold which is very precisely contoured with respect to the desired final configuration. A three dimensional template is then placed over the feed stock and the resist coating is then cut.

As indicated in the Discussion of the Prior Art, the hand cutting of the three dimensional work piece is even more difficult and time consuming than the cutting of a two dimensional work piece. A constant pressure must be exerted to precisely track the contours of the work piece to completely cut through the mask, and lightly score the metal surface without causing any undercuts or blow-outs.

In digitizing an existing template for the robotic device, a similar process is followed. The "ASEA" robot is equipped with its own computer guidance system and is normally programmed by the "teach" method which uses a robotic tracking method of tracing the stencil with a stylus to "teach" the robot the desired contour to be followed. The "ASEA" robot is currently available from "ASEA, Inc.," 4 New King St., White Plains, N.Y. 10604. The stencil attached to the robot is placed manually at the initial reference starting position and that key point data is entered. This operation "teaches" the robot that this position is to be assumed with respect to programmed operation for all future beginning reference points. The digital positioning values for all three axes and the required traverse speeds are then stored in the computer memory. The robot is then moved manually along the template to the next position and the second set of x,y,z coordinate values is entered. The second set is then stored in memory and these steps are completed until the perimeter of the template has been completely traversed by the stencil. For long straight cuts along a two dimensional plane, only two entry points need be entered. Along a complex curve or a three dimensional curve traversing all three x,y,z axes, each coordinate value requiring a shift in the rotational axes of the robot needs to be entered. Once the entire outline of the three dimensional template has been entered into the robotic memory, it can then be transferred to a magnetic storage medium such as magnetic tape or a disc drive.

The reference point data is used as a simple way of obtaining coordinate transformation in straight line positioning for the robot. The reference point entered by the key point data at 19 does not cause any robotic motion, it simply defines the first, second, third...n, points of the pattern of movement to be traversed. The distance and direction to the subsequent reference point is calculated between reference points and executed relative to the point in space at which the robot is situated before the next reference point is entered.

The "ASEA" robot will work in one of two modes. If point to point control is selected, each of the several axes that have to move simultaneously to reach a new point begins at once, and the trajectory is not controlled. All axes will start at the same position, and each motor will stop when its driven portion has reached its new programmed position.

The robotic device is also equipped with a separate instruction function wherein the motor speed for each axes is selected so that all axes reach the new position simultaneously. This is particularly useful in following contours generated by a series of closely related key data points along a complex x,y,z coordinate curve.

As indicated by the dotted line 24, the key point data from the robotic tracking of the existing template can be read out onto magnetic tape as indicated at 23 or any other form of permanent magnetic storage media. When it is desired to institute a production run, the magnetic tape created for the part that is to be produced is read back into the robotic memory for execution of the three dimensional template.

A third method of generating masks for the automated chemical milling process of the present invention is illustrated at 20 and 21 wherein new mask geometry is created on a CRT through the use of a program entitled "CADAM". The "CADAM" program is a commercially available, licensed software program available through CADAM, Inc. in Burbank, Calif., or from IBM.

In using the "CADAM" program, the part to be created is displayed on the CRT and a series of key points are entered along the part to define the new mask geometry. The key points are then filled in by the operator at the CRT to completely enclose the perimeter of the new template geometry. If sequential etching baths are desired, each of the templates are generated by the operator at the CRT by entering the desired key points to define the x,y values of each of the points along the perimeter. The new template geometry is digitized as it is created by the CPU 16, and if desired a printout may be generated as indicated at 18 to check the mask geometry against the feed stock example or an initial mock up of the part that may have been created in the model shop.

If the process involves the creation of a number of parts from a single piece of feed stock, a separate nesting subroutine 22 is used to nest the various template perimeters in the most efficient manner for the particular size and configuration of the beginning feed stock. The "nesting" subroutine indicated at 22 is a software program entitled "CAMSCO" and is available through "CAMSCO, Inc.", 1200 N. Bowser, Richardson, Tex. 75081.

The digitizing of the existing template as indicated at 17, or the creation of the new template geometry, as indicated at 21, is stored in magnetic form in either temporary or permanent storage media as it is created. If it has been stored in a temporary memory, it is then converted to magnetic tape or disc as indicated at 23 for future use in the manufacturing method. Inasmuch as a large aircraft manufacturer may have thousands of templates used for chemical milling parts for the aircraft, it is desired to have a permanent magnetic record as indicated at 23. This record may be used whenever it is desired to begin a production run for a particular part or series of parts.

As illustrated in FIG. 1, a separate CPU 25 has been illustrated for use in the production line environment. In applicants device, CPU 16 is a computer that is normally used in the design and engineering departments while CPU 25 is a separate computer that is used to operate the Kongsberg Flatbed Drafting Table. It would be possible however, to use the same computer for both functions if desired. The ASEA robot has an integral CPU which may be used on line with CPU 25, or subsituted therefor, if the template geometry has been generated through the "teach" function.

Instructions from CPU 25 to scribe control 26 utilizes only the x and y axes for flat feed stock. In the Kongsberg Flatbed Drafting Table, one motor is used for the x axis and one motor is used for the y axis. These are the only two values that are digitized and used to control the positioning of the scribing tool. The scribing tool is controlled by an analog signal generated by the scribe control 26, as will be hereinafter described in detail.

When the process is used on three dimensional work pieces, the generation of the commands for the scribe control is substantially more complex. As indicated by the dotted line 24*a*, the magnetic tape 23 created by the robotic device during the "teach" function may be reinserted into the CPU controlling the robotic device and each of the rotational motions will be generated in the same sequence and order as they were "taught" to the device during the key point data step 19.

The robotic device contains three to six motors for traversing the x,y,z axes whereas the flatbed plotter uses two motors for traversing the x,y axes. New three dimensional templates may be created via a "CATIA" program as indicated at 21 for new template geometry. "CATIA" was developed by Dassault in France as a modification to the previously described "CADAM" program. "CATIA" is currently available from IBM. A separate set of rotational commands must also be generated as indicated at 26 for each of the motors in the robotic device. This step computes the direction and speed of each of the motors necessary to traverse the x,y,z contour defined by the digitized x,y,z values at 21. This may be done as a separate routine between the CPU and the robotic control, or it may be generated at the time the new template geometry is created by the CPU 16.

The robotic control indicated at 27 is the process of controlling the relative rotational axes of each of the motors in the robotic device.

As is apparent from FIG. 1, the scribe controls indicated at 26 may be derived in the three dimensional operating mode from the robotic control 27, or in the two dimensional mode from the Kongsberg table 28.

Scribe control 26 is capable of effecting three separate operations on each of the pieces of feed stock 11 that are flow coated as indicated at 12. These three steps are the mask cutting indicated at 14, the marking step 29, and the resealing step indicated at 30.

If a simple one-step etching process is utilized, the CPU 25 will drive the x,y motors of the Kongsberg table as indicated at 28, while the scribe control 26 regulates the pressure of the cutting knife and the orientation of the cutting blade during the mask cutting operation 14. Since the most is somewhat resilient, it is difficult to see the cut lines in the mask. Therefore after the mask has been cut, it is conventional practice to mark the scribe line as indicated by 29 with a marker to assist the workmen who remove parts of the mask in finding the area to be removed. Inasmuch as several thousand types of work pieces may come through the production line for the etching bath 31, each with its own particular configuration, and each with a separate number of templates scribed thereon, the marking step, while not absolutely essential, it is highly desirable to achieve error-free etching or chemical milling.

If multiple etching baths are desired for the work piece 11, the scribe control 26 then recoats all but one of the template lines cut during the mask cutting operation 14. Normally, the innermost template is then removed as indicated at 32 and the work piece is then immersed in the etching bath 31, if multiple masks and multiple etching steps are involved, the work piece is recycled as indicated at 32*a* for the removal of the second mask and a return to the etching bath along 31*a*. After each of the areas have been etched on the work piece, it is then de-smutted in a de-smutting bath 33 and sent to a router for part separation as indicated at 34. The part separation step 34 may be used when a plurality of parts are nested on a single piece of feed stock, or when a portion of the feed stock is used for the positioning of the reference or alignment holes that guide the work piece through the various manufacturing steps that it will encounter.

Figure 2:
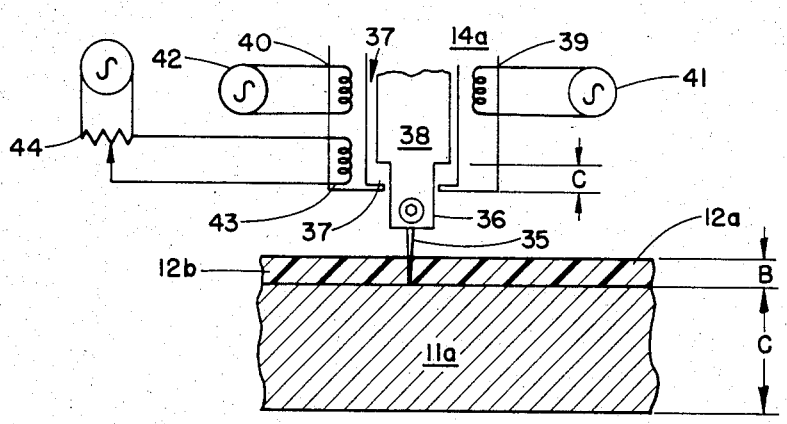
FIG. 2 is a diagramatic illustration of the tangentially controlled scribing tool, the resist coating and a metal work piece to be etched.

As illustrated in diagramatic form in FIG. 2, the tangentially controlled scribing tool uses a single knife 35 that is secured in a central barrel 36 by means of a set screw 37. Barrel 36 is provided for both rotational and reciprocating movement by means of an air bearing 37 which completely surrounds torque piston 38. The piston 38 is responsive to two orthogonal stator windings 39 and 40 which are in turn connected to sine 41 and cosine 42 analog voltages received from the scribe control 26 illustrated in FIG. 1. These voltages turn the torque receiver piston 38, and subsequently the knife's leading edge to ensure that knife 35 always presents its normal cutting edge to the material consistant with changes in the direction of the motion of the tool. A third winding 43 is set by the operator through a potentiometer or other signal device 44 to control the downward pressure exerted by piston 38 on knife 35. The effect of this downward pressure will be hereinafter more fully described with respect to FIG. 5.

As illustrated in FIG. 2, the aluminum or titanium work piece 11 has been greatly exaggerated in depth relative to the size of the tangential scribing tool to illustrate the relationship between the depth of the feed stock 11*a*, and the depth of the flowkote mask 12*a*. In actual practice, the aluminum or titanium work stock 11*a* ranges in thickness as illustrated by the arrows "A" from ⅛ of an inch to ½ an inch in thickness. The thickness of the mask resist coating 12*a*, indicated by the arrows "B" in FIG. 2 is approximately 10 mils. The reciprocal range of knife 35, indicated by the arrows "C" in FIG. 2 is approximately ⅛ of an inch. Thus it is apparent, that even with two dimensional flat stock, the tangentially controlled scribing tool 14*a* is able to compensate for any waves or variations in surface thickness of the feed stock 11*a* as it scribes the surface.

The feed stock 11*a* may be any metal that is suitable for etching or other chemical milling. In the preferred embodiment it takes the place of aluminum or one of its alloys, or titanium or one of its alloys commonly used in the aircraft and aerospace industry. One such aluminum alloy is generally designated in the trade as 20-20-4, and meets a federal specification entitled Q-A-250/4 or Q-A-250/5. One of the titanium alloys used in the present invention is designated in the trade as a 6-6-2 titanium alloy, and meets a military specification entitled T-9046. It includes in addition to titanium, 6 parts of aluminum, 6 parts of vanaduim and 2 parts of tin.

These metals are etched in separate etching baths although it is apparent from the prior art that a wide variety of etching solutions could be used. In the preferred practice of the present invention, the aluminum alloys are etched in a sodium hydroxide alkaline bath while the titanium alloys are etched in a hydrofluoric acid bath. Other desired baths for aluminum may include caustic soda or potassium hydroxide, and another chemical bath that may be highly desirable for titanium is nitric/hydrofluoric acid.

While aluminum and its alloys and titanium and its alloys are the principle metals used in the present invention, it is apparent that any metal or material susceptible to etching by an oxidizing acid or strong alkali solution would be usable with the present invention.

Figure 3:
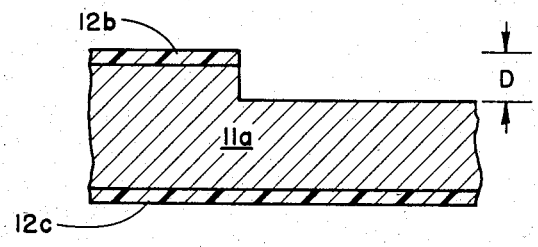
FIG. 3 is a cross section view of the metal work piece illustrated in FIG. 2 after the etching step.

As illustrated in FIG. 3, the work piece 11*a* illustrated in FIG. 2 has been immersed in an etching bath to remove a portion of the metal by chemical milling. The distance "D" representihg the depth of the etchant cut varies widely depending on the material, the etchant bath, the temperature, and the period of time in which the material is immersed in the etchant. The parameters involved in the etching steps such as the concentration of active agent, the temperature, the etching rate, etc. will vary from application to application.

In the preferred embodiment, when aluminum and its alloys are etched in sodium hydroxide, from 0.0008 to 0.0022 mils of material will be removed for each minute of immersion in the etchant bath. When titanium and its alloys are immersed in hydrofluoric acid, from 0.0006–0.0012 mils will be removed for each minute in the hydrofluoric etchant bath. It should be noted that all of the work piece 11*a* is protected by the masking material applied at step 12, except that portion which is desired to be chemically milled. Thus, the lower mask 12*c* protects the underside or in the case of an aircraft skin section, the outer side of the feed stock 11*a*.

Figure 4:
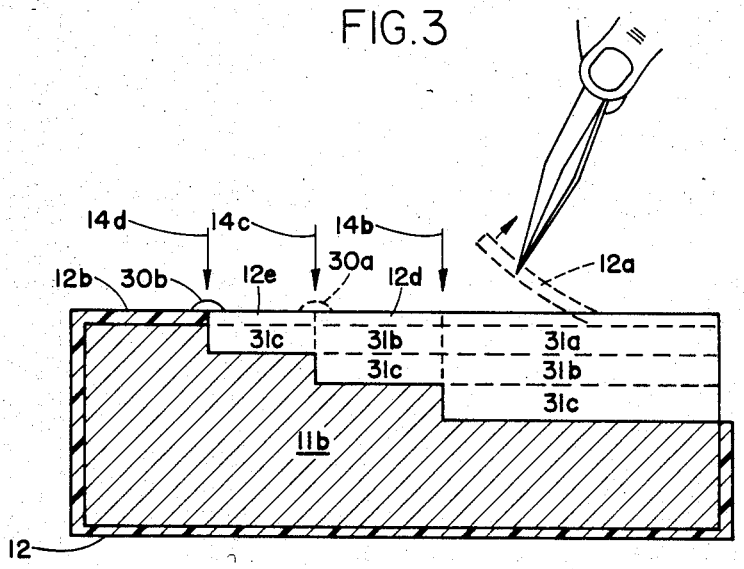
FIG. 4 is a cross section and diagramatic view which illustrates the sequential etching process.

As illustrated in FIG. 4, a work piece 11*b* has been subjected to a multiple etching bath. Multiple cuts were made at 14*b*, 14*c* and 14*d* through the protective mask to define separate masks 12*a*, 12*b* and 12*c*. After the cuts 14*a*–14*d* were made, cuts 14*c* and 14*d* were resealed with "TURCO" or the styrene/butadiene copolymer mask material as indicated at 30*a* and 30*b*. The initial portion 12*a* was removed by hand as illustrated in FIG. 4 and the first layer of metal was etched away as indicated by the dotted line surrounding 31*a*. Following this initial etching, the sealant material 38*a* was removed, the cut mask material indicated at 12*d* was removed, and the work piece was reinserted in the etchant bath. During the second immersion, the metal indicated at 31*b* was removed by action of the etchant bath.

After the desired amount of metal had been removed, the third section of cut mask material 12*e* was removed and the portions of metal indicated at 31*c* were removed during the third immersion in the etchant bath. Thus it is apparent that many possible various surface configurations could be milled by virtue of the multiple etchant bath process illustrated in FIG. 4.

Figure 5:
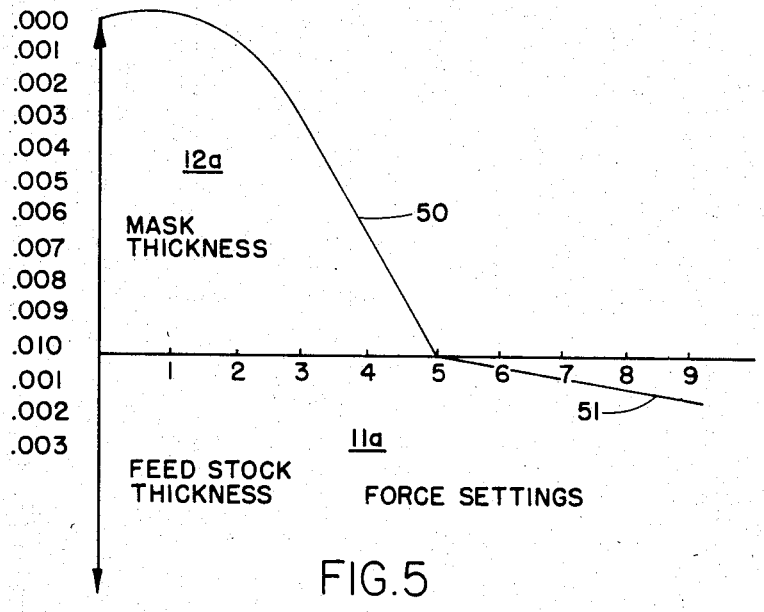
FIG. 5 is a curve illustrating the depth of the cut made by the tangentially controlled scribing device in response to various "force settings".

The curve illustrated in FIG. 5 illustrates the depth of the cut by the knife blade 35 through the mask 12*a* and into the metal substrate 11*a*. The horizontal axis labeled "force settings" are indicative of the signals provided by means 44 which originate from the scribe control 26 illustrated in FIG. 1. While normally this is preset by the operator at the time the cuts are made in the mask, the signal could be supplied as part of the data processing signal stored on magnetic tape 23. As indicated by the slope of curve 50 and 51, the pressure generated by the torque piston 38 and winding 43 is sufficient to readily cut through the mask, but only lightly score the feed stock. As illustrated in FIG. 5, the maximum depth of cut through the aluminum feed stock was 0.002 inches even at the highest "force" setting for the tangentially controlled scribing tool. This is well within the 0.004 limit set by current military specifications. Inasmuch as the titanium feed stock is substantially harder than the aluminum feed stock, the depth of cut into the titanium is even less than the cut into the aluminum.

Figure 6:
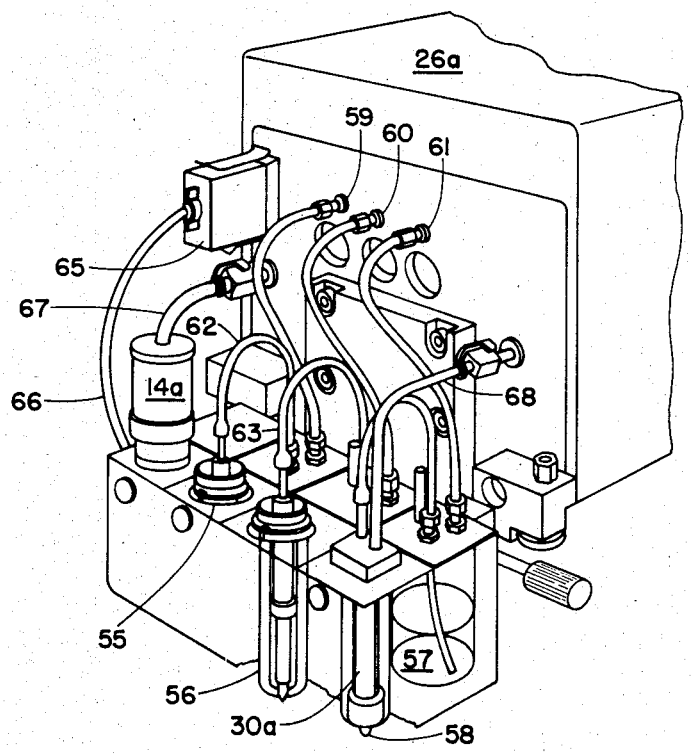
FIG. 6 is a perspective view of the carriage assembly that carries the tangentially controlled scribing device, the markers, and the recoating device for sealing previously scribed cuts.
Figure 7:
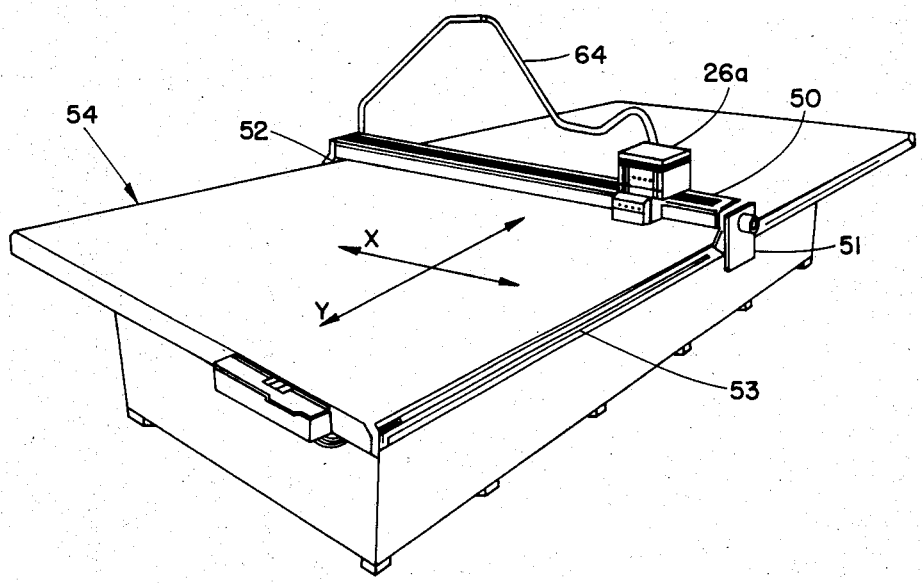
FIG. 7 is a perspective view of the Kongsberg Flatbed Drafting Table.

The scribe control step illustrated at 26 in FIG. 1 is more fully illustrated in FIG. 6 in the form of scribe control head 26*a*. The scribe control head 26*a* is mounted on a Kongsberg Flatbed Drafting Table as illustrated in FIG. 7. This particular drafting table may be extended in 1½ meter sections up to a maximum length of 10.5 meters. The scribe control 26*a* is carried by a gantry 50 for movements along the x axis, and by carriage means 51 and 52 which reciprocate along guide rails 53 and 54 (not shown) mounted on either side of the flatbed drafting table. A pair of high performance dc servo motors provide for precise x,y positioning of the scribe control 26*a* by means of rack and pinion drive mechanisms. The pinions for carriage 51 and 52 are connected via a single shaft and engage racks mounted in the guide rails 53 and 54 for reciprocation along the y axis of the table. A single pinion in the scribe control 26*a* reciprocates the scribe control along a rack mounted in the gantry 50. The surface flatness of the bed is plus or minus 0.75 millimeters, or well within the ⅛ vertical reciprocating dimension c indicated in FIG. 2. The cutting speed of the table can be as high as 42 meters per minute.

The scribe control 26*a* illustrated in FIG. 6 has the tangentially controlled scribing tool 14*a* and a pair of marking pens 55 and 56, one of which is cut away for the purposes of illustration in FIG. 6. The scribe control 26*a* also contains a resealing means 30*a* that is connected to a reservoir of maskant material such as "TURCO", or any sealant that is compatible with the maskant material and capable of withstanding the acid or caustic bath to which the mask material will be subjected during the multiple etching steps. The resealing step 30 is carried out by means 30*a* by means of a rolling ball 58, a brush, or other fluid dispenser as may be desired, depending upon the flow characteristics of material to be dispensed therefrom. In some applications of the invention it may be desirable to combine the sealant with an ink or other contrasting pigment to provide a single step that marks and reseals the cut scribe line. A plurality of air pressurizing means 59, 60, and 61 pressurize the containers of sealant 57 and ink containers (not shown). The inks are then dispensed to marking pens 55 and 56 by means of tubes 62 and 63 for marking the cut lines after the tangentially controlled cutting tool 14*a* has cut through the mask.

Electronic control for the scribing tool is maintained through an overhead cable 64 illustrated in FIG. 7 to the scribe control 26*a*. Electronic control of each of the cutting, marking and resealing stages is provided by means of connector 65 and control line 66. The air supply for the tangentially controlled cutting tools air bearing is provided through conduit 67 while conduit 68 provides a similar supply for the ball applicator means 30*a* used in resealing the cut scribe lines.

While the Kongsberg Flatbed Drafting Table illustrated in FIG. 7 is capable of relatively high rate of movement in the x and y axes, it normally does so only on straight cuts. The software provided for the Kongsberg table at 28 in FIG. 1 provides the CPU 25 with a "look ahead" feature that enables the CPU to look ahead at the next block of instructions and slow the scribing tool 26*a* when a change in direction is indicated. For example, if the device is in the mask cutting mode, with the tangentially controlled scribing tool cutting through the mask cut material 12*a*, any change in angle for the knife blade 35 of more than 7° results in a vertical reciprocation of the piston 38 illustrated in FIG. 2. The movement of the scribing tool 26a is momentarily halted, the blade 35 is raised and repositioned with respect to its new angular orientation by means of signal generators 41 and 42 provided by the scribe control 26. It should be noted that the instructions from the CPU 25 to the Kongsberg table 28 to the scribe control 26 are in analog form insofar as the tangentially controlled scribing tool is concerned.

The reciprocal cutting feature of this device enables the operator of the device to insert a very narrow knife point for blade 35 and to cut holes in the mask material of very small diameter. A round circular hole as small as ¼ of an inch in diameter may be smoothly cut in the mask material with the present invention. Cuts of this size radius have been heretofore impossible with a hand cutting operation. In addition to making cuts that were previously impossible, the present invention makes possible high speed scribing with high precision and repeatability. As indicated previously, one work piece three feet by four feet with multiple parts that took 6 to 8 hours to hand scribe and mark by hand took 11 minutes to scribe and mark with the present invention.

Figure 8:
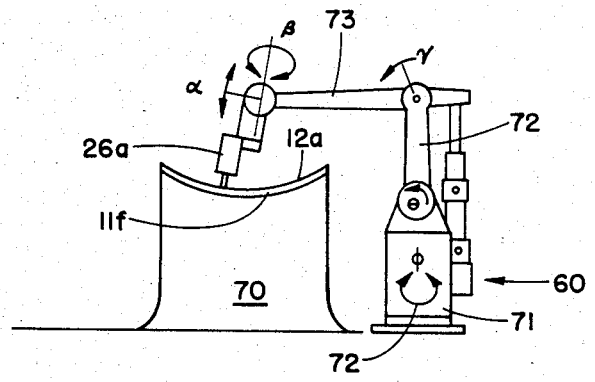
FIG. 8 is a diagramatic view of the ASEA robotic device and a three dimensional work piece.
Figure 9:
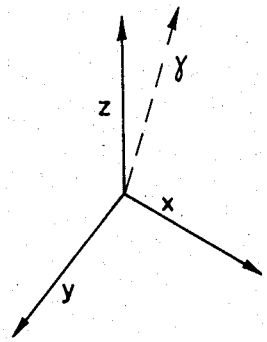
FIG. 9 is a diagramatic illustration of x,y,z and $\gamma$ coordinate axes.
Figure 10:
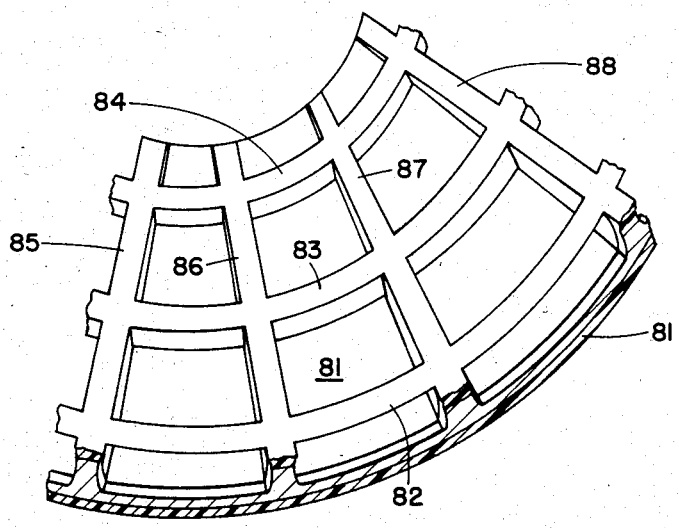
FIG. 10 is a partially cross sectional and perspective view of a portion of a three dimensional work piece formed by the present invention.

The present invention also makes possible the application of the scribe control 26a to three dimensional work pieces as illustrated in FIGS. 8–10. The scribe control 26a is mounted on a robotic device 60 for cutting, marking and masking the interior of a work piece as illustrated in FIG. 8. The master mold 70 has thereon a work piece 11f that has been preshaped to a three dimensional contour.

The work piece 11f has also been coated with coating 12a and is ready for cutting, marking and resealing as was previously described with respect to FIGS. 2–4.

The robotic device 60 is equipped with a plurality of rotational axes, each of which assists the device in transporting the scribe control 26a from one point on the x,y,z axes to a second point on the x,y,z axes. The pedestal 71 rotates about a pedestal turning moment 72 which is described as $\phi$. The second robotic motion is the in and out moment of the lower arm 72 and is described by the angle $\theta$. The third rotational axes prescribes the up and down motion of arm 73 about the angle $\gamma$. The robot may also be equipped with three separate motions for the wrist, although only two are illustrated in FIG. 8. The first wrist moment is $\alpha$ which is referred to as a "wrist bend", and a second rotational axis $\beta$ which is indicated as a wrist turn. These five rotational axes make it possible for the robot to traverse from any x,y,z coordinate point to the next x,y,z coordinate point. As was indicated previously with respect to FIG. 1, each of the servo motors responsible for moving the robot about each of the five axes illustrated in FIG. 8 may be programmed to run simultaneously so that all axes start at the same time and run at the same motor speed. Each motor then stops when the part it drives has reached its new programmed position. Alternately, the robotic device manufactured by "ASEA" has an instruction function that will provide a motor speed for each axes to be selected so that all axes reach the new programmed position simultaneously. This provides for smooth contouring of three dimensional work surfaces when the robot is traversing a curve through three dimensional space. Also, as was indicated previously, the tangentially controlled scribing tool exerts a constant downward pressure on the scribing knife throughout a reciprocal range of ⅛ of an inch. This reciprocal movement of the knife provides that the knife remains in a constant force engagement with the aluminum or titanium work piece throughout the various movements of the robots arms. The robot has a positional tolerance for all five axes of ±0.004 mm which is compensated for by the air bearing reciprocal tolerance of ⅛" as indicated at "C" in FIG. 2.

FIG. 9 illustrates the traditional x,y,z axes normally used to span three dimensional space. A fourth axis $\gamma$ is illustrated to note that any set of x,y,z axes could be used, provided that no two axes are parallel to one another. If a particular set of x,y,z axes is more efficient in calculating the movement through three dimensional space with respect to a given surface part configuration, then the x,y,z axes for that particular part may be altered to provide for more efficient calculation of the movements from one x,y,z point coordinate value to another.

FIG. 10 is an illustration of a part of an aircraft that has been chemically milled after the mask was cut by a robotic device as illustrated in FIG. 8. As indicated, the aircraft skin 81 remains coated with the resist material on its lower surface throughout the entire milling operation. The ribs 82, 83 and 84 and stringers 85, 86, 87 and 88 are integrally formed with the skin 81 to provide a unitary structure that is light weight, strong and free from any mechanical joints, rivets, screws, or other fastening devices. The natural undercutting action of the chemical milling process will provide a natural "T" or "I-beam" configuration for strengthening the metal skin 81.

Figure 11:
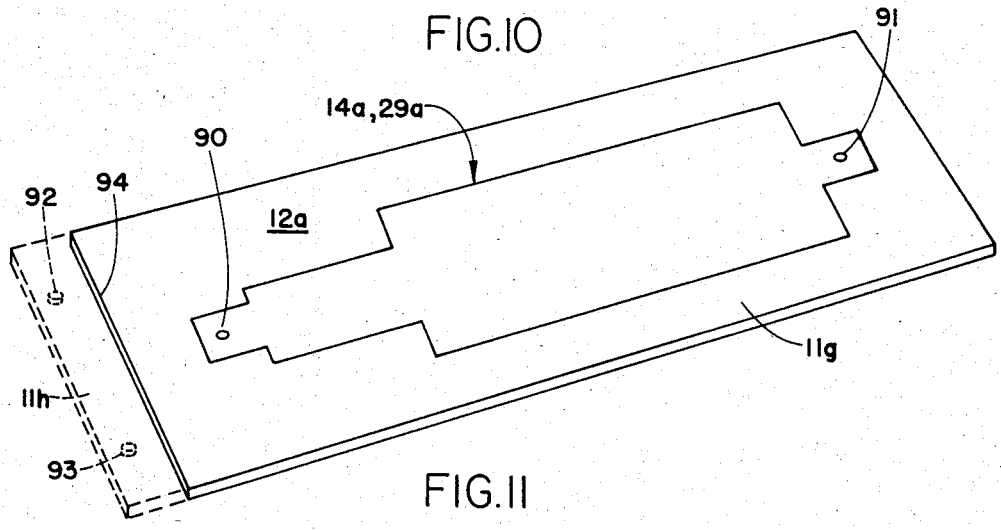
FIG. 11 is a perspective view illustrating the registration or tooling holes that may be formed by the present invention.

FIG. 11 illustrates one further advantage of the present invention. The metal part 11g has defined thereon a template outline that has been cut and marked along 14a, 29a as illustrated in FIG. 1. A pair of tooling holes 90 and 91 have been defined within the chemical milled areas for gripping the part as it traverses through the various manufacturing steps that it will encounter. The part 11g is covered with a mask material 12a outside the perimeter line defined by 14a, 29a. The perimeter line 14a, 29a defined on part 11g is typical of a part configuration that might be formed. An optional method for providing tooling holes is illustrated in the phantom lines for part 11h and tooling holes 92 and 93. This type of registration or tooling hole configuration might be utilized if it were desired to have a part configuration having no holes therein which was chemically milled to reduced thickness. After completion of the chemical milling and de-smutting operation, the tab portion 11h would be cut along the outer perimeter line 94 by a router or metal saw in the part separation process.

As hereinbefore described, the present invention eliminates tedious hand scribing of the mask on flat and three dimensional parts intended for chemical milling. It may eliminate the construction of new templates for new parts that are to be manufactured and will eliminate the use of existing templates for parts that have already been designed. It eliminates the hand marking of multiple scribed areas and cuts and eliminates the hand application of TURCO sealer on the cuts to be used in sequential etching of the part. It provides a controlled depth of cut through the mask into the metal part that is very precise. The cutting can be conducted at high speeds with high precision and high repeatability. The tangentially controlled scribing tool makes it possible to cut curves on both flat and three dimensional surfaces, and to define holes and curves that have not heretofore been previously possible with hand scribed operations.

What is claimed is:

1. An automated chemical milling process for metals, said process comprising the steps of:
a. coating the metal to be etched with a resist coating;
b. digitizing the area(s) to be etched to define x,y coordinate values for the perimeter of the area(s) to be etched;
c. automatically scribing the metal and coating with a scribing tool, said scribing tool cutting through said coating along the perimeter defined by the x,y coordinate values;
d. removing the resist coating from the area(s) to be etched; and
e. immersing said partially coated metal into an etching solution for a predetermined period of time to remove a predetermined amount of metal from the uncoated area(s);

2. An automated chemical milling process as claimed in claim 1, which further includes the steps of:
a. separately scribing more than one area to be etched for each metal part;
b. recoating the cut scribed lines for all but one of the areas to be etched;
c. sequentially removing the resist coating from each of the areas to be etched between separate additional immersions in said etching solution;
whereby each of the defined areas to be etched is immersed in said solution for differing cumulative time periods.

3. An automated chemical milling process for metals as claimed in claims 1 or 2, which further includes the step of marking the perimeter(s) of the area(s) cut by said scribing tool with a visible marker, said marker marking said coating along the perimeter line(s) defined by the x,y coordinate values, said marking occurring before said resist coating is removed.

4. An automated chemical milling process for metals as claimed in claim 2, wherein the recoating step utilizes a visable sealant to simultaneously reseal and mark the cut scribe lines.

5. An automated chemical milling process for metals as claimed in claims 1 or 2, which further includes the step of nesting the perimeter lines of each of the areas to be etched when more than one part is to be etched from a single metal plate.

6. An automated chemical milling process for metals as claimed in claim 1, which further includes the step of applying a predetermined constant downward force on the scribing tool as it moves along a line defined by two x,y point values.

7. An automated chemical milling process for metals as claimed in claim 6, which further includes the step of raising the scribing tool whenever a line or curve described by a future set of x,y values from a line or curve scribed from a previous set of x,y values by more than 7°.

8. An automated chemical milling process for metals as claimed in claims 1 or 2 or 6 or 7, in which the metal is aluminum or its alloys, and the etching bath is an alkali metal hydroxide.

9. An automated chemical milling process for metals as claimed in claims 1 or 2 or 6 or 7, in which the metal is titanium or its alloys, and the etching bath is a hydrohalic acid.

10. An automated chemical milling process for metals as claimed in claims 1 or 2 or 6 or 7, wherein said resist coating is a butadiene styrene copolymer.

11. An automated chemical milling process for metals as claimed in claims 1 or 2 or 6 or 7, which further includes the scribing and etching of registration marks in a metal plate.

12. An automated chemical milling process for metals as claimed in claim 11 wherein tooling holes are subsequently formed from said registration marks.

13. An automated chemical milling process for three-dimensional metal parts, said process comprising the steps of:
a. coating the metal to be etched with a resist coating;
b. defining a three-dimensional space with three separate x,y,z axes, wherein no two axes are parallel to one another;
c. digitizing the x,y,z point coordinate values along a perimeter of the three-dimensional area to be etched;
d. automatically scribing the coating and metal with a scribing tool, said scribing tool cutting through said coating along the three-dimensional perimeter defined by said x,y,z point coordinate value;
e. removing the resist coating from the area to be etched;
f. immersing said partially coated metal into an etching solution for a predetermined period of time to remove a predetermined amount of metal from the uncoated area.

14. An automated chemical milling process for three-dimensional metal parts, as claimed in claim 13, which further includes the steps of:
a. separately scribing more than one area to be etched for a single three-dimensional metal part;
b. recoating the cut scribed lines for all but one of the areas to be etched;
c. sequentially removing the areas to be etched between separate immersions in the etching solution;
whereby each of the defined areas to be etched is immersed in said solution for differing cumulative time periods.

15. An automated chemical milling process for three-dimensional metal parts as claimed in claim 14, wherein the recoating step utilizes a visable sealant material to simultaneously reseal and mark the cut scribe lines.

16. An automated chemical milling process for three-dimensional metal parts as claimed in claim 13, which further includes the steps of defining three or more rotational axes for the scribing tool, said scribing tool selecting one or more of said rotational axes as it traverses said three dimensional space defined by said x,y,z coordinate values.

17. An automated chemical milling process for three-dimensional metal parts as claimed in claims 13 or 14 or 16, which further includes the step of marking the areas cut by said scribing tool with a visible marker, said marker marking said coating along the three-dimensional surface traversed by said scribing tool, said marking occurring before said resist coating is removed.

18. An automated chemical milling process for three-dimesnional metal parts as claimed in claims 13 or 14 or 15 or 16, which further includes the step of nesting the areas to be etched when more than one part is to be etched from a single metal plate.

19. An automated chemical milling process for three-dimensional metal parts as claimed in claims 13 or 14 or 16, which further includes the step of applying a predetermined constant force on the scribing tool to force said scribing tool into engagement with said three-dimensional metal part, said force being applied perpendicularly to a plane defined by at least two of said x,y,z coordinate point values for each point traversed by said scribing tool.

20. An automated chemical milling process for three dimensional metal parts as claimed in claim 16, which further includes a step of raising the scribing tool whenever a line or curve described by a future set of x,y,z point coordinate values varies from a line or curve described from a previous set of x,y,z point coordinate values by more than 7°.

21. An automated chemical milling process for three dimensional metal parts as claimed in claims 13 or 14 or 15 or 16, in which the metal is aluminum or its alloys, and the etching bath if an alkali metal hydroxide.

22. An automated chemical milling process for three dimensional metal parts as claimed in claims 13 or 14 or 15 or 16, in which the metal is titanium or its alloys, and the etching bath is hydrohalic acid.

23. An automated chemical milling process for three dimensional metal parts as claimed in claims 13 or 14 or 15 or 16, wherein said resist coating is a butadiene styrene copolymer.

24. An automated chemical milling process for three dimensional metal parts as claimed in claims 13 or 14 or 15 or 16, which further includes the step of scribing and etching registration marks in the three-dimensional metal parts.

25. An automated chemical milling process for three dimensional metal parts as claimed in claim 24 wherein tooling holes are subsequently formed from said registration marks.

* * * * *